US011566854B2

(12) United States Patent
Alahyari et al.

(10) Patent No.: US 11,566,854 B2
(45) Date of Patent: Jan. 31, 2023

(54) FOLDED CONDUIT FOR HEAT EXCHANGER APPLICATIONS

(71) Applicant: Carrier Corporation, Palm Beach Gardens, FL (US)

(72) Inventors: Abbas A. Alahyari, Manchester, CT (US); Michael F. Taras, Fayetteville, NY (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 8 days.

(21) Appl. No.: 16/067,009

(22) PCT Filed: Dec. 20, 2016

(86) PCT No.: PCT/US2016/067744

§ 371 (c)(1),
(2) Date: Jun. 28, 2018

(87) PCT Pub. No.: WO2017/116845

PCT Pub. Date: Jul. 6, 2017

(65) Prior Publication Data

US 2019/0017752 A1 Jan. 17, 2019

Related U.S. Application Data

(60) Provisional application No. 62/271,483, filed on Dec. 28, 2015.

(51) Int. Cl.
*F28F 1/02* (2006.01)
*F28D 1/03* (2006.01)
(Continued)

(52) U.S. Cl.
CPC ..... *F28F 1/022* (2013.01); *F28D 1/0391* (2013.01); *F28D 1/05333* (2013.01);
(Continued)

(58) Field of Classification Search
CPC .. F28D 1/05316; F28D 1/053; F28D 1/05308; F28D 1/0391; F28D 1/05333;
(Continued)

(56) References Cited

U.S. PATENT DOCUMENTS 2,506,120 A 5/1950 Turner
2,934,322 A * 4/1960 Hazard ..... F28D 1/0308 165/147
(Continued)

FOREIGN PATENT DOCUMENTS

CN 1275672 C 9/2006
CN 103814268 A 5/2014
(Continued)

OTHER PUBLICATIONS

Chinese Office Action; Application No. 201680076746,8; dated Sep. 18, 2019; 8 Pages.
(Continued)

*Primary Examiner* — Tho V Duong
(74) *Attorney, Agent, or Firm* — Cantor Colburn LLP

(57) ABSTRACT

A heat exchange conduit includes a body having a first portion including a first flow channel and a second portion including a second flow channel. A cross-section of the heat exchange conduit varies over a length of the heat exchange conduit.

14 Claims, 9 Drawing Sheets

(51) Int. Cl.
*F28F 1/40* (2006.01)
*F28F 1/00* (2006.01)
*F28F 13/18* (2006.01)
*F28D 1/053* (2006.01)

(52) U.S. Cl.
CPC ..... *F28F 1/006* (2013.01); *F28F 1/025* (2013.01); *F28F 1/40* (2013.01); *F28F 13/185* (2013.01); *F28F 2210/08* (2013.01)

(58) Field of Classification Search
CPC .. F28F 1/025; F28F 1/022; F28F 1/006; F28F 1/40; F28F 13/185; F28F 13/08; F28F 13/02; F28F 9/0263
USPC ..... 165/147, 109.1
See application file for complete search history.

(56) References Cited

U.S. PATENT DOCUMENTS 3,596,495 A * 8/1971 Huggins ..... F28D 1/0478 72/370.18
3,613,782 A * 10/1971 Mason ..... F28D 9/0068 165/166
4,805,693 A 2/1989 Flessate
5,441,106 A 8/1995 Yukitake
5,491,997 A 2/1996 Ogawa
5,908,070 A 6/1999 Kato et al.
6,209,202 B1 4/2001 Rhodes et al.
6,241,012 B1 6/2001 Yu et al.
6,510,870 B1 * 1/2003 Valaszkai ..... B21C 37/20 138/117
7,111,673 B2 9/2006 Hugill
7,657,986 B2 * 2/2010 Anders ..... F28F 3/04 29/890.07
7,942,137 B2 * 5/2011 Geskes ..... F28F 13/14 165/174
8,661,676 B2 * 3/2014 McNulty ..... F28F 3/046 165/177
10,302,369 B1 * 5/2019 Siebert ..... F28F 1/426
2004/0200602 A1 * 10/2004 Hugill ..... B01D 3/14 165/110
2005/0092476 A1 * 5/2005 Hu ..... F28F 1/022 165/177
2009/0014165 A1 1/2009 Zobel et al.
2009/0043114 A1 * 2/2009 Taheri ..... B01J 8/067 549/257
2009/0183862 A1 * 7/2009 Benezech ..... F28D 9/0031 165/170
2009/0293461 A1 * 12/2009 Miyagawa ..... F01N 3/043 60/299
2009/0314475 A1 * 12/2009 Jeon ..... F28D 1/0391 165/109.1
2010/0243208 A1 * 9/2010 Kar ..... B01J 8/067 165/96
2011/0284195 A1 11/2011 Chowdhury et al.
2014/0262165 A1 * 9/2014 Ishimori ..... F28F 1/06 165/109.1
2015/0060027 A1 * 3/2015 Tawa ..... B21D 53/02 165/143
2017/0198988 A1 * 7/2017 Herring ..... F28F 9/0246
2017/0205149 A1 * 7/2017 Herring ..... B22F 3/1055

FOREIGN PATENT DOCUMENTS

DE 4340378 A1 6/1994
DE 19723801 A1 * 12/1997 ..... B21D 53/04
EP 2409104 B1 11/2015
GB 26557 5/1912
JP S57136093 A 8/1982
JP H11264686 A 9/1999
JP 2016536551 A 11/2016
WO 03011418 A1 2/2003
WO 2015050441 A1 4/2015

OTHER PUBLICATIONS

International Preliminary Report on Patentability; Application No. PCT/US2016/067744; dated Jul. 3, 2018; 8 Pages.
International Search Report issued in Application No. PCT/US2016/067744 dated Mar. 23, 2017, 6 pages.
Written Opinion issued in International Application No. PCT/US2016/067744 dated Mar. 21, 2017, 7 pages.
Chinese Third Office Action; International Application No. 201680076746.8; International Filing Date: Jun. 28, 2018 dated Nov. 20, 2020; 10 pages with translation.
Chinese Fourth Office Action; Application No. 201680076746.8; dated May 8, 2021; 7 pages.

* cited by examiner

FOLDED CONDUIT FOR HEAT EXCHANGER APPLICATIONS

CROSS REFERENCE TO RELATED APPLICATION

This application claims priority to PCT/US2016/067744, filed Dec. 20, 2016 which claims the benefit of U.S. Provisional Application No. 62/271,483, filed Dec. 28, 2015, both of which are incorporated by reference in their entirety herein.

BACKGROUND

This disclosure relates generally to heat exchangers and, more particularly, to a heat exchanger conduit formed by folding a sheet of material.

In recent years, much interest and design effort has been focused on the efficient operation of heat exchangers of refrigerant systems, particularly condensers and evaporators. A relatively recent advancement in heat exchanger technology includes the development and application of parallel flow (such as microchannel, minichannel, brazed-plate, plate-fin, or plate-and frame) heat exchangers as condensers and evaporators. These conduits of parallel flow heat exchangers are often formed via an extrusion process during which one or more internal walls or partitions are created to define multiple flow channels within each conduit.

SUMMARY

According to a first embodiment, a heat exchange conduit includes a body having a first portion including a first flow channel and a second portion including a second flow channel. A cross-section of the heat exchange conduit varies over a length of the heat exchange conduit.

In addition to one or more of the features described above, or as an alternative, in further embodiments a configuration of at least one of the first flow channel and the second flow channel varies over the length of the heat exchange conduit.

In addition to one or more of the features described above, or as an alternative, in further embodiments a hydraulic diameter of the heat exchange conduit varies over the length of the heat exchange conduit.

In addition to one or more of the features described above, or as an alternative, in further embodiments a ratio of the length of the first flow channel or second flow channel of the heat exchange conduit to a hydraulic diameter of the first flow channel or the second flow channel, respectively, is optimized based on the type and phase of a fluid configured to flow through the heat exchange conduit.

In addition to one or more of the features described above, or as an alternative, in further embodiments when the fluid is at least one of a liquid and a two-phase refrigerant, a ratio of the length to the hydraulic diameter of at least one of the first flow channel and the second flow channel is about 15 to about 65.

In addition to one or more of the features described above, or as an alternative, in further embodiments when the fluid is a vapor refrigerant, a ratio of the length to the hydraulic diameter of at least one of the first flow channel and the second flow channel is about 1.5 to about 5.

In addition to one or more of the features described above, or as an alternative, in further embodiments when the fluid is water, a ratio of the length to the hydraulic diameter of at least one of the first flow channel and the second flow channel is about 50 to about 200.

In addition to one or more of the features described above, or as an alternative, in further embodiments when the fluid is a brine, a ratio of the length to the hydraulic diameter of at least one of the first flow channel and the second flow channel is about 150 to about 600.

In addition to one or more of the features described above, or as an alternative, in further embodiments the body includes a generally planar sheet of material folded to form the first portion and the second portion.

In addition to one or more of the features described above, or as an alternative, in further embodiments an interior surface of the heat exchange conduit includes a texture or pattern to form a boundary layer disruption of a fluid passing through the tube.

In addition to one or more of the features described above, or as an alternative, in further embodiments an exterior surface of the heat exchange conduit includes a texture or pattern to form a boundary layer disruption of a fluid passing around the tube.

According to another embodiment, a heat exchanger includes a first header, a second header, and a plurality of heat exchange conduits arranged in spaced parallel relationship and fluidly coupling the first header and second header. A configuration of at least one of the plurality of heat exchange conduits varies along a length of the heat exchange conduit.

In addition to one or more of the features described above, or as an alternative, in further embodiments the at least one of the plurality of heat exchange conduits includes a first folded portion having one or more first flow channels and a second folded portion having one or more second flow channels. At least one of a cross-sectional area and a cross-sectional shape of the one or more first flow channels or the one or more second flow channels varies over the length of the heat exchange conduit.

In addition to one or more of the features described above, or as an alternative, in further embodiments the first folded portion is part of a first tube bank and the second folded portion is part of a second tube bank.

In addition to one or more of the features described above, or as an alternative, in further embodiments a hydraulic diameter of at least one of the first flow channel and second flow channel varies over the length of the heat exchange conduit.

According to an embodiment, a method of forming a heat exchange conduit includes providing a generally planar piece of material and folding a first end of the piece of material to form a first portion of the heat exchange conduit. The first portion includes at least one first flow channel. A second, opposite end of the piece of material is folded to form a second portion of the heat exchange conduit. The second portion includes at least one second flow channel. A cross-section of the heat exchange conduit is non-uniform over the length of the tube.

In addition to one or more of the features described above, or as an alternative, in further embodiments a single surface of the piece of material forms a leading edge, trailing edge, first surface and second surface of the heat exchange conduit.

In addition to one or more of the features described above, or as an alternative, in further embodiments forming the first portion includes forming a plurality of first flow channels.

In addition to one or more of the features described above, or as an alternative, in further embodiments including removing part of the piece of material such that a first section of the piece of material has a first width and a second section of the piece of material has a second width. The first width is different than the second width.

In addition to one or more of the features described above, or as an alternative, in further embodiments altering the piece of material to include a texture or pattern before folding the material. When the piece of material is folded to form the heat exchange conduit, the texture or pattern is arranged at an interior surface of the heat exchange conduit.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
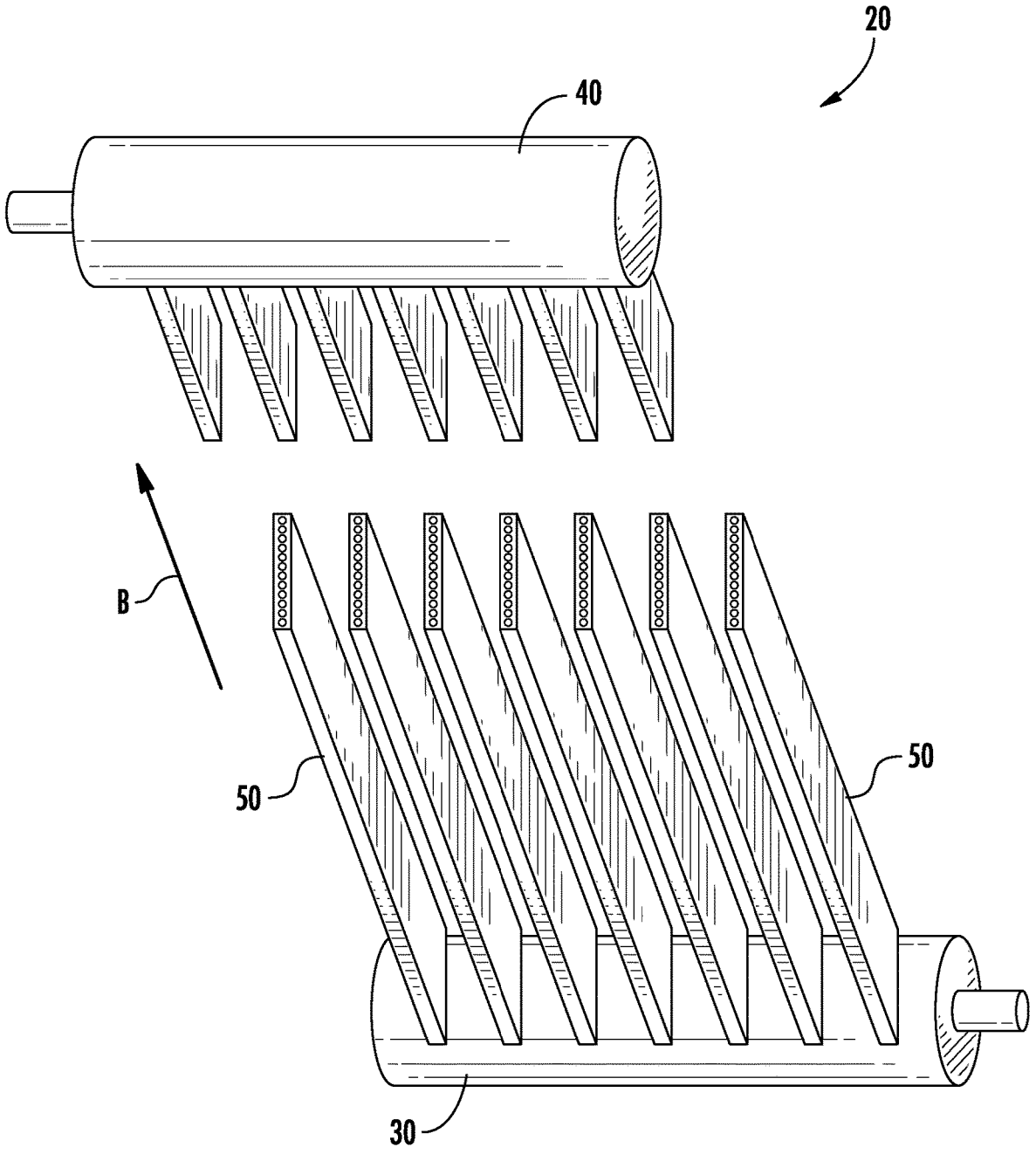
FIG. 1 is an example of a conventional heat exchanger.

Referring now to FIG. 1, an example of a parallel flow heat exchanger is illustrated. The heat exchanger 20 includes a first manifold or header 30, a second manifold or header 40 spaced apart from the first manifold 30, and a plurality of heat exchange conduits 50 extending in a spaced parallel relationship between and fluidly connecting the first manifold 30 and the second manifold 40. In the illustrated, non-limiting embodiments, the first header 30 and the second header 40 are oriented generally horizontally and the heat exchange conduits 50 extend generally vertically between the two headers 30, 40. By arranging the conduits 50 vertically, water condensate collected on the conduits 50 is more easily drained from the heat exchanger 30. In the non-limiting embodiments illustrated in the FIGS., the headers 30, 40 comprise hollow, closed end cylinders having a circular cross-section. However, headers 30, 40 having other cross-sectional shapes, such as semi-elliptical, square, rectangular, hexagonal, octagonal, or other cross-sections for example, are within the scope of the disclosure. The heat exchanger 20 may be used as either a condenser or an evaporator in a vapor compression system, such as for example a heat pump system, an air conditioning system, or the like.

Figure 2:
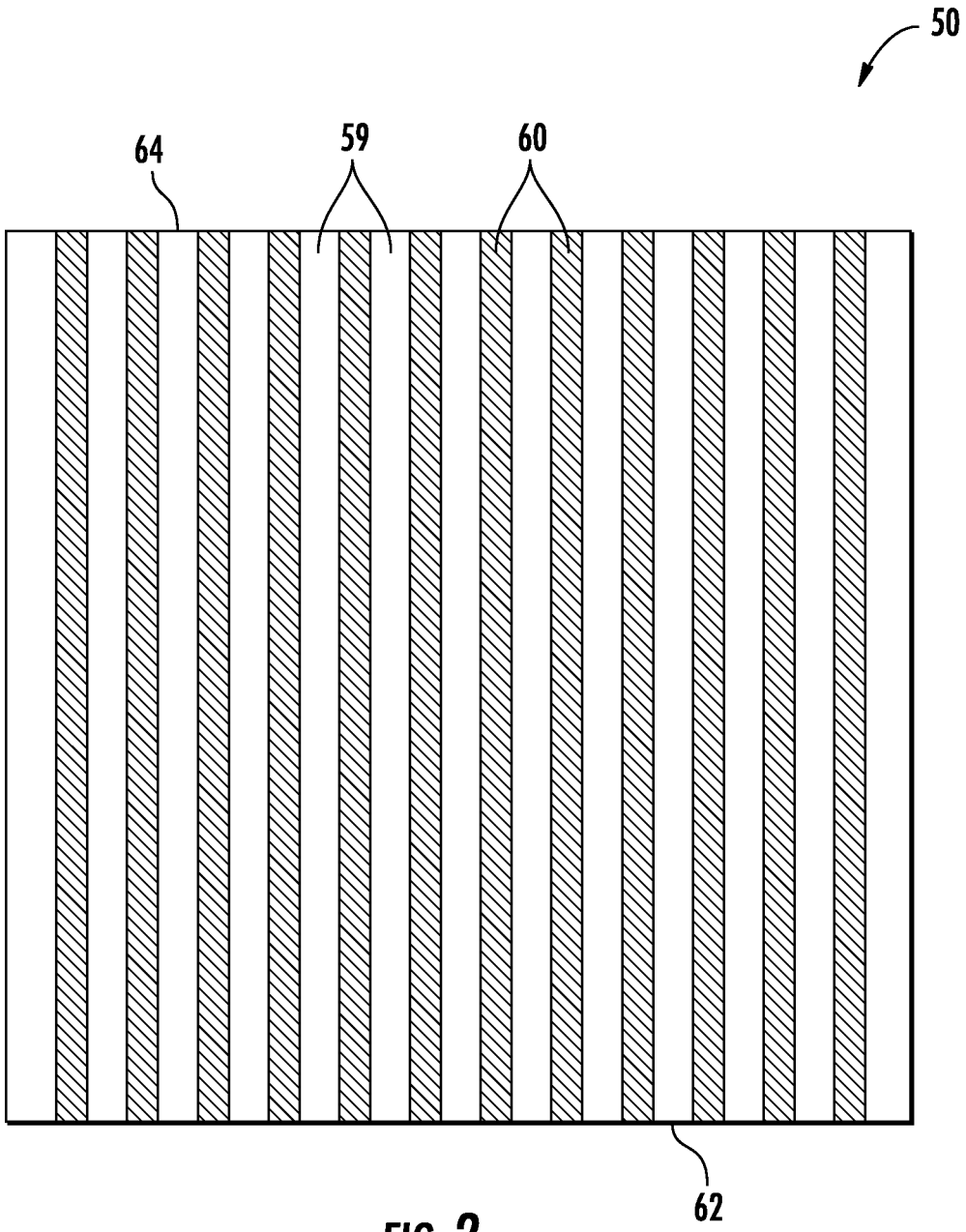
FIG. 2 is a perspective, partly sectioned view of an example of a parallel flow
Figure 3:
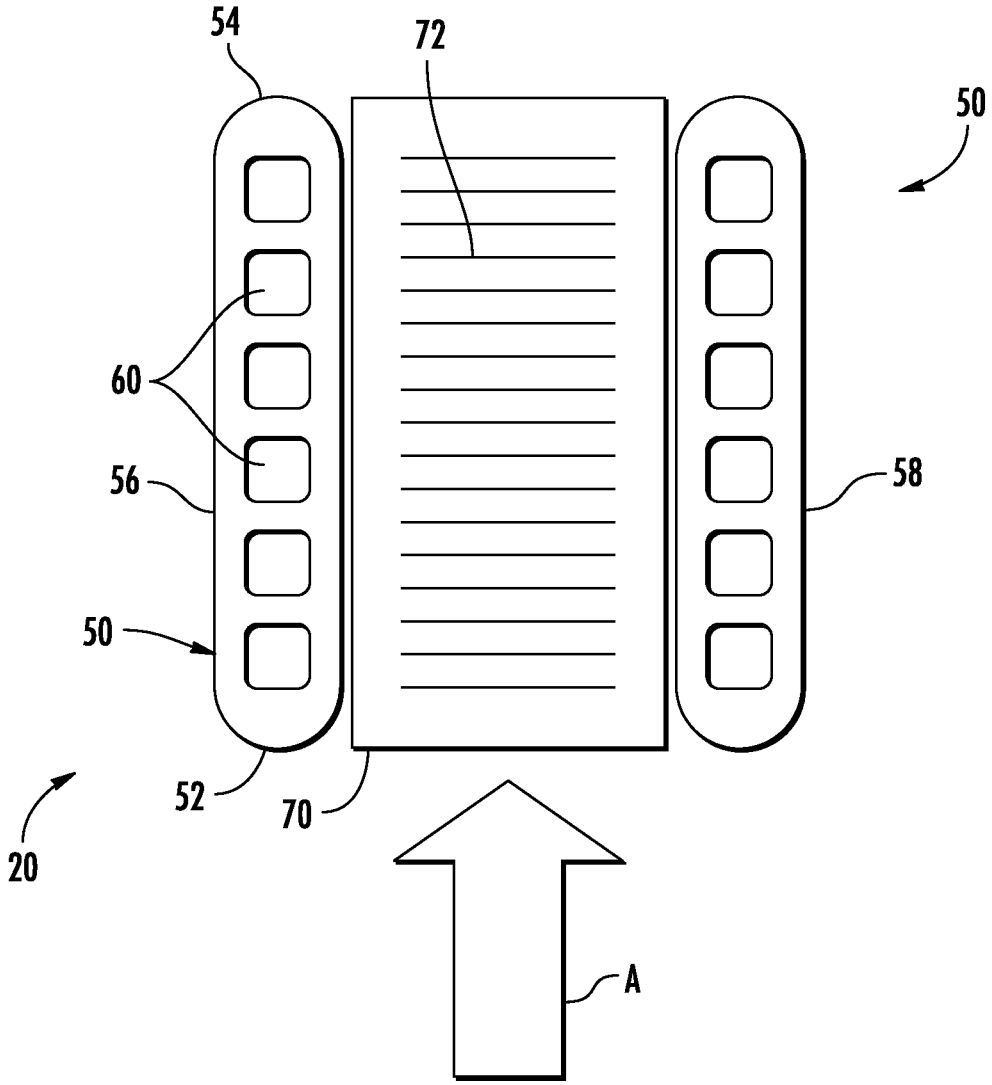
FIG. 3 is a cross-sectional view of a portion of the parallel flow heat exchanger of FIG. 2.

Referring now to FIGS. 2 and 3, each heat exchange conduit 50 comprises a leading edge 52, a trailing edge 54, a first surface 56, and a second surface 58. The leading edge 52 of each heat exchanger conduit 50 is upstream of its respective trailing edge 54 with respect to the flow of a second heat transfer fluid A (e.g., air, air having dilute ethylene gas therein, nitrogen, and the like) through the heat exchanger 20. The interior flow passage of each heat exchange conduit 50 may be divided by interior walls 59 into a plurality of discrete flow channels 60 that establish fluid communication between the respective first and second manifolds 30, 40. The flow channels 60 may have a circular cross-section, a rectangular cross-section, a trapezoidal cross-section, a triangular cross-section, or another non-circular cross-section (e.g. elliptical, star shaped, closed polygon having straight or curved sides). The heat exchange conduits 50 including the discrete flow channels 60 may be formed using known techniques and materials, including extrusion.

A plurality of heat transfer features 70 (FIG. 3) may be disposed between and rigidly attached, e.g., by a furnace braze process, welding process, or the like, to the heat exchange conduits 50, in order to enhance external heat transfer and provide structural rigidity to the heat exchanger 20. The heat transfer features may be selected from lancings, louveres, slots, and fins for example. Heat exchange between the fluid within the heat exchanger conduits 50 and the air flow A, occurs through the outside surfaces 56, 58 of the heat exchange conduits 50 collectively forming the primary heat exchange surface, and also through the heat exchange surface of heat transfer features 70, which form the secondary heat exchange surface.

Figure 4:
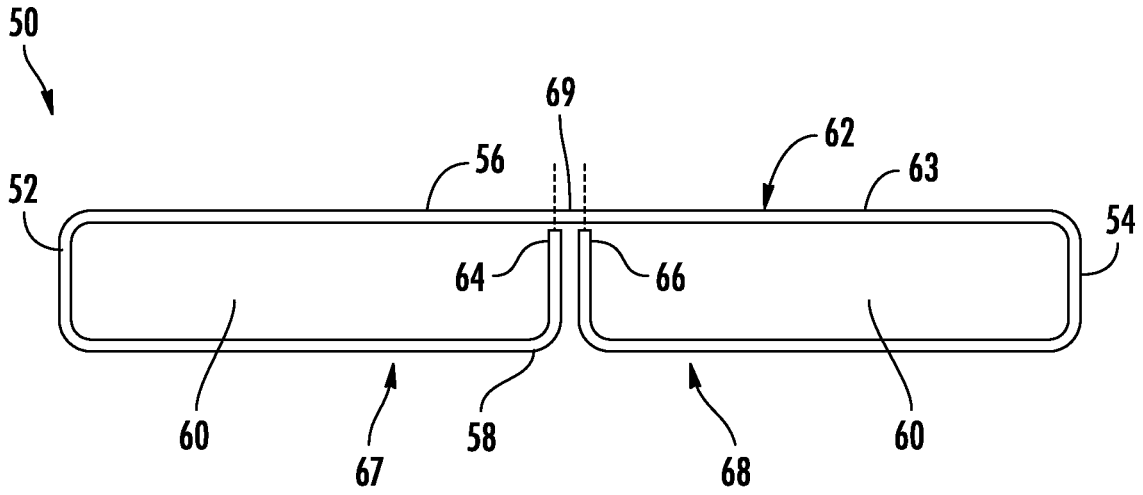
FIG. 4 is a cross-sectional view of a folded heat exchange conduit according to an embodiment.

Referring now to FIGS. 4-9, the heat exchange conduits 50 will be described in more detail. The heat exchange conduits 50 and the plurality of flow channels 60 defined therein are formed by folding a generally planar piece or sheet of material 62. Examples of the type of material that may be used include, but are not limited to, sheet metal and non-metallic materials, such as polymers, thermally enhanced polymer based composites, or other suitable materials for example. An example of a folded heat exchanger conduit 50 is illustrated in FIG. 4. As shown, a flat piece of material 62 has been folded such that a single surface 63 of the piece of material 62 defines the leading edge 52, trailing edge 54, first surface 56, and second surface 58. By folding opposing edges 64, 66 of the sheet of material 62 to extend between the first and second surfaces 56, 58 of the conduit 50, a first portion 67 and a second portion 68 of the heat exchange conduit 50 are formed, each having a single flow channel 60. In the illustrated, non-limiting embodiments, the first portion 67 and the second portion 68 are substantially identical. However, embodiments where the first portion 67 and the second portion 68 vary in size and/or configuration are also within the scope of the disclosure.

In addition, a portion of the heat exchange conduit 50, for example the portion of the first surface 56, arranged generally between the first portion 67 and the second portion 68 identified by numeral 69 in FIG. 4, may be slotted or perforated to reduce the total material of the heat exchange conduit 50 and to allow for drainage to prevent the collection of condensate on the external surface (e.g., single surface 63) of the conduit 50.

As illustrated and described herein, each heat exchange conduit 50 includes both a first portion 67 and a second portion 68. Depending on the configuration of the heat exchanger 20, in some embodiments such as when the heat exchanger 20 has a multi-pass configuration for example, the first portion 67 of the heat exchange conduit 50 may be configured as a first tube bank having a first flow configuration and the second portion 68 of the conduit 50 may be configured as a second tube bank having a second flow configuration. For example, one or more of the conduits 50 may be configured such that the first portion 67 of the heat exchange conduit 50 receives a fluid flow in a first direction, and the second portion 68 of the same heat exchange conduit 50 receives a fluid flow in an opposite direction. However, both the first portion 67 and the second portion 68 of an adjacent conduit 50 of the heat exchanger 20 may, but need not be configured to receive a fluid flow in the same direction.

Figure 5:
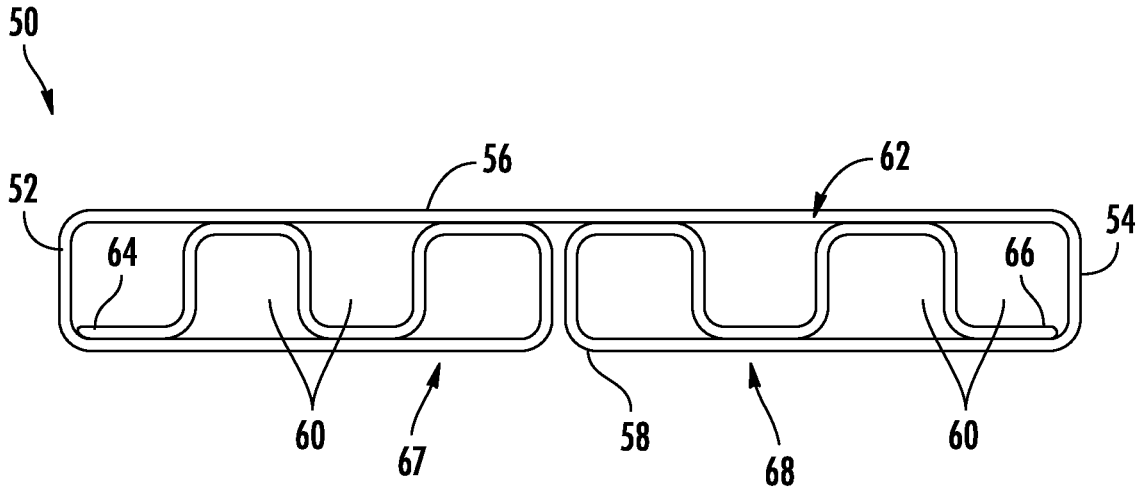
FIG. 5 is a cross-sectional view of another folded heat exchange conduit according to an embodiment.

In another embodiment, illustrated in FIG. 5, at least one of the opposing ends 64, 66 of the sheet of material 62 is bent to define a plurality of flow channels 60 within the first portion 67 and/or second portion 68 of the heat exchange conduit 50, respectively. Although the ends 64, 66 of the sheet of material 62 are illustrated as being bent to form a plurality of similar flow channels 60 having a generally rectangular cross-section, embodiments where the flow channels 60 vary in size, shape, cross-sectional flow area, have varying surface characteristics (e.g., having differing surface roughness or textures, coatings, embossed patterns, and the like), or further include inserts of same or different configuration are also within the scope of the disclosure.

Figure 6:
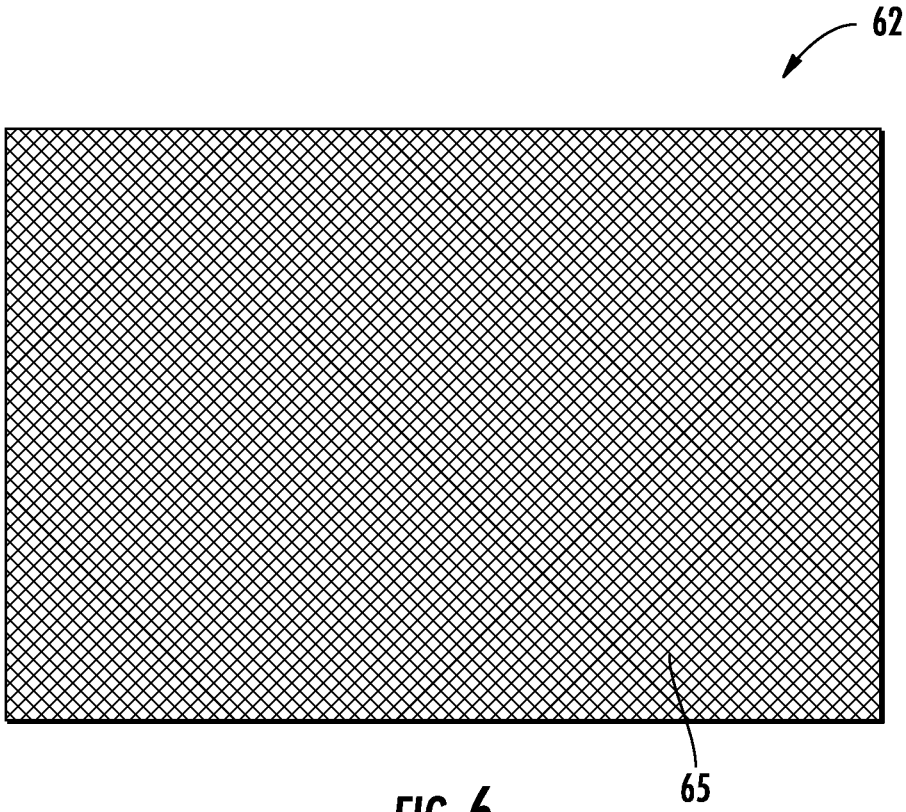
FIG. 6 is a top view of a sheet of material used to form a folded heat exchange conduit according to an embodiment.
Figure 6A:
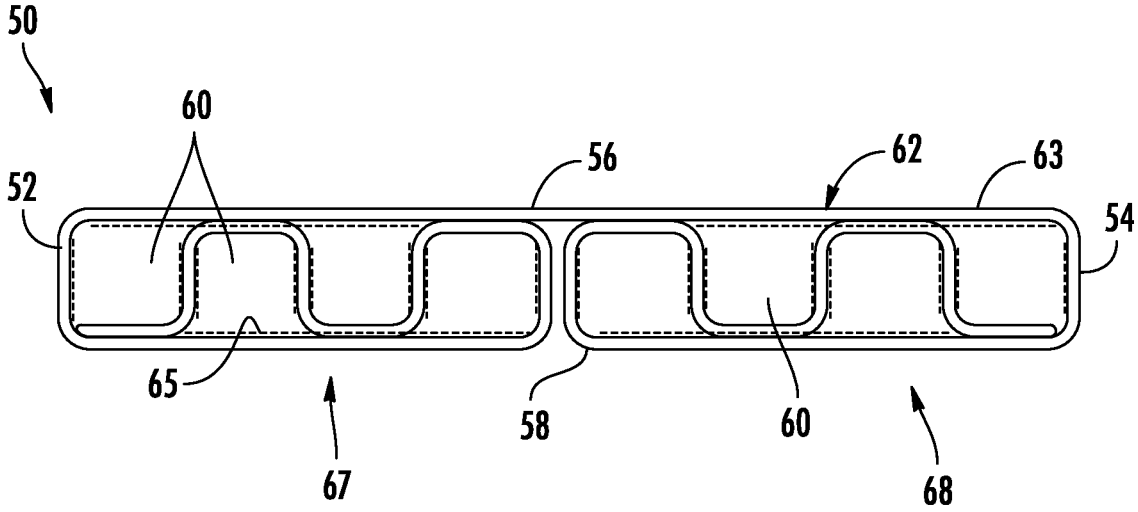
FIG. 6*a* is a cross-sectional view of the folded heat exchange conduit formed from the sheet of material of FIG. 6 according to an embodiment.

With reference now to FIGS. 6 and 6*a*, at least a portion of the surface 65 of the sheet of material 62 that forms an interior surface of the conduit 50 may be stamped, embossed, coated, or sprayed. When the sheet 62 is folded into a heat exchanger conduit 50, the textured surface forms a feature extending over at least a portion of the interior surface 65 of the flow channels 60. This feature may aid in heat transfer, for example by enhancing nucleate boiling, thin film condensation, or boundary layer re-initiation of a fluid as it flows through the flow channels 60. Although this feature is described as being formed on an interior surface 65 of the flow channels 60, the feature may alternatively or additionally be formed on the exterior surface 63 of the heat exchange conduit 50. Alternatively, or in addition, a pattern may be formed by at least partially removing portions from the sheet of material 62, such as by punching, machining, etching, abrasion (e.g., grinding), drilling, and the like for example. When the sheet of material 62 is folded, the portions of the sheet 62 that include the pattern can form fins, similar to serrated fins. These fins can create a boundary layer re-initiation zone which can enhance heat transfer. Although the pattern is described as forming fins, other enhancements, such as louvers, lances, winglets, and other vortex generators for example, are also within the scope of this disclosure.

Figure 7:
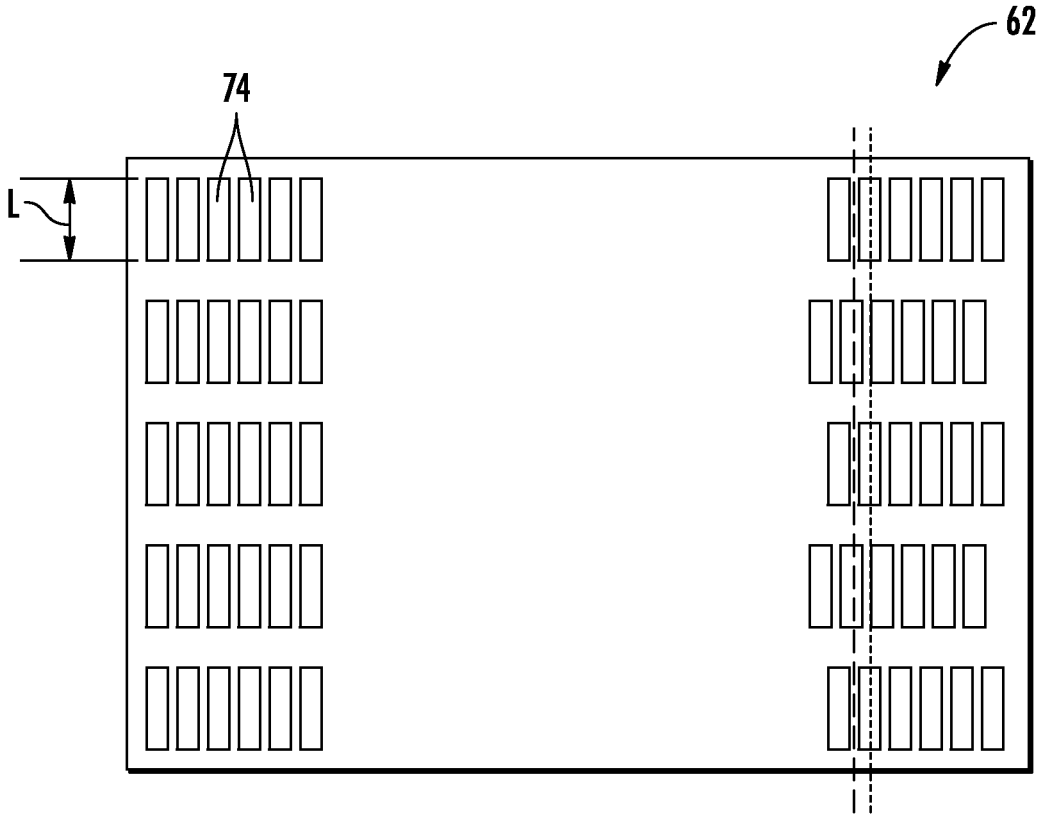
FIG. 7 is a top view of another sheet of material used to form a folded heat exchange conduit according to an embodiment.
Figure 7A:
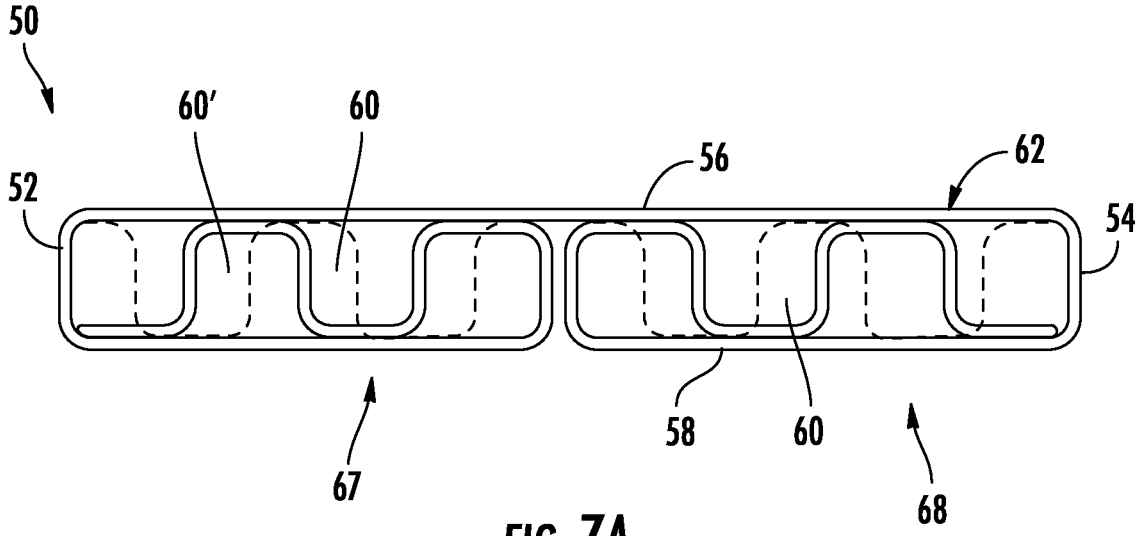
FIG. 7*a* is a cross-sectional view of the folded heat exchange conduit formed from the sheet of material of FIG. 7 according to an embodiment.
Figure 7B:
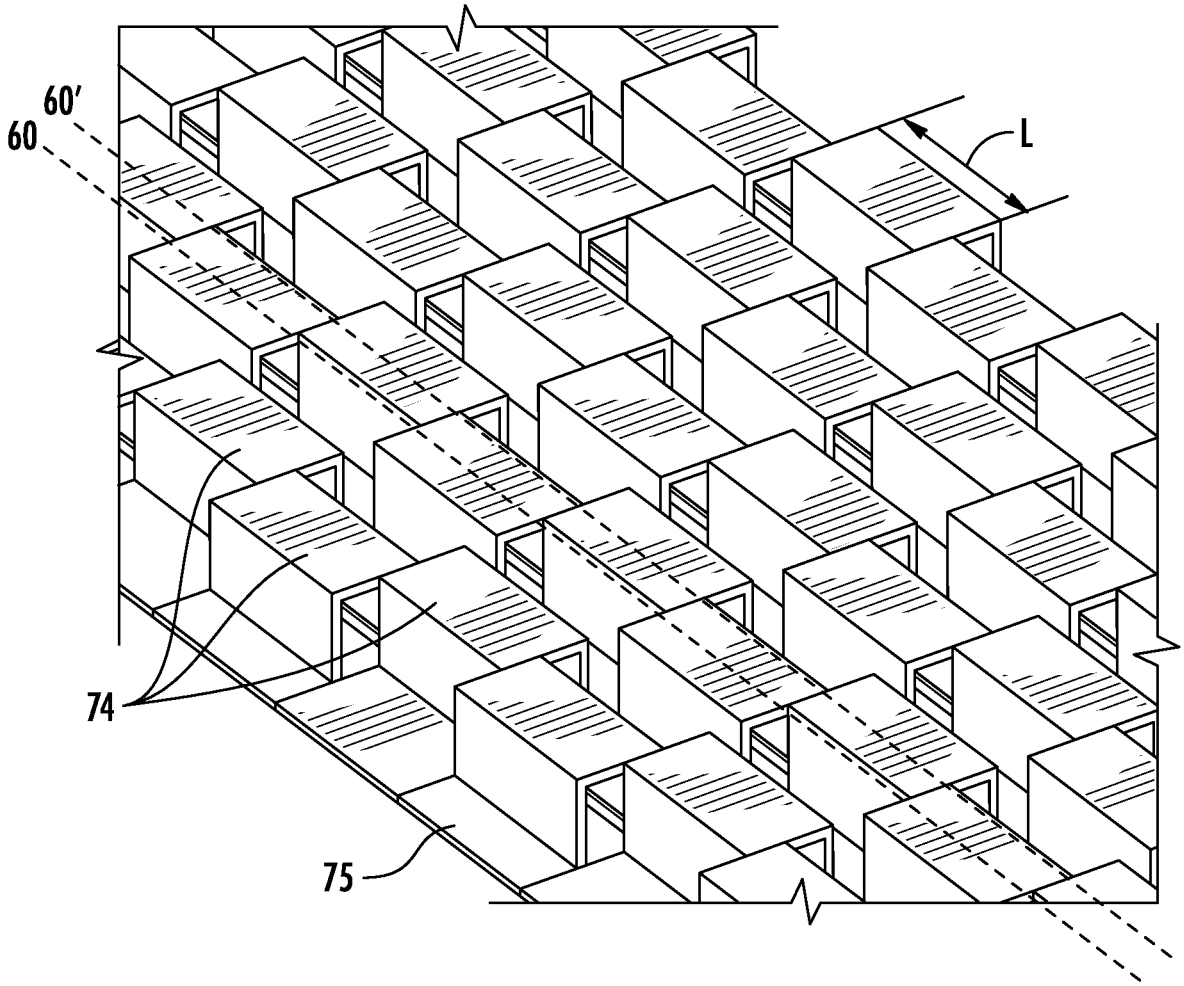
FIG. 7*b* is a perspective view of an insert for use with a folded heat exchange conduit according to an embodiment.

With reference to FIGS. 7, 7*a*, and 7*h*, at least a portion of the unfolded piece of material 62 has been manufactured (e.g., punched) with a plurality of features 73, such as generally hollow rectangular lances as shown in the FIGS. for example. In other embodiments, a separate component 75 having a plurality of features 73 formed therein may be inserted into an interior of the one or more flow channels 60. As a result of the pattern formed, when the sheet of material 62 is folded, the plurality of features 73 form a plurality of internal features 74 which may be arranged in a non-linear configuration. As shown in FIG. 7*a*, a portion of the internal features 74, such as illustrated in broken lines, are shifted laterally relative to an adjacent portion (e.g., shifted relative to an adjacent upstream and/or downstream feature 74) of the internal features 74, such that portions of the internal features 74 are offset from one another. This offset may be achieved by forming an offset in the features 73 of the sheet 62. For example, a first feature 73 may be shifted by up to half a distance of a width of an opening formed at least in part by an adjacent upstream feature 73. Accordingly, the length L extending between offset features 73, in the illustrated embodiment for example, defines a distinct flow channel 60 such that when the conduit 50 is formed via folding, adjacent internal features 74 with respect to the direction of flow of heat transfer fluid through the conduit 50, form offset flow channels 60, 60'.

Figure 8:
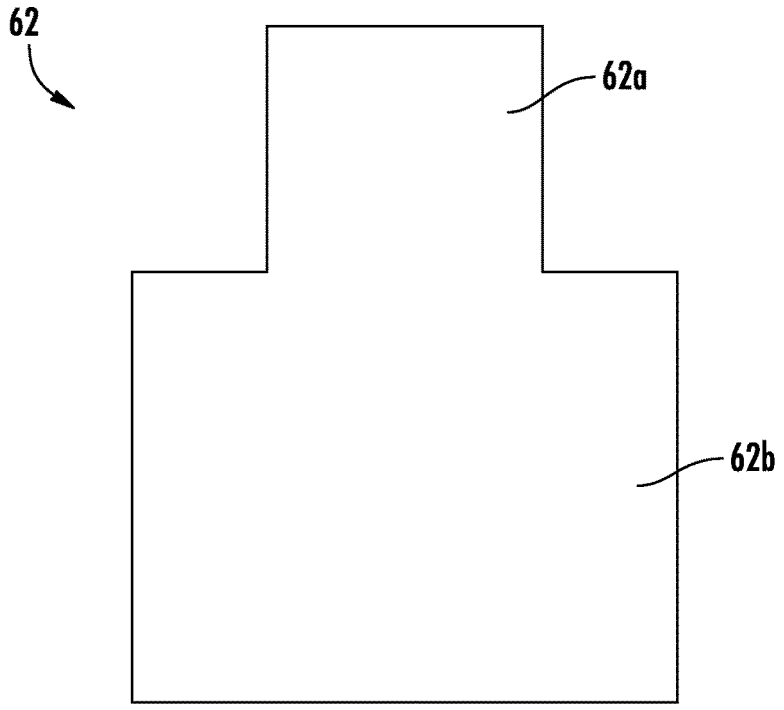
FIG. 8 is a top view of another sheet of material used to form a folded heat exchange conduit according to an embodiment.
Figure 9:
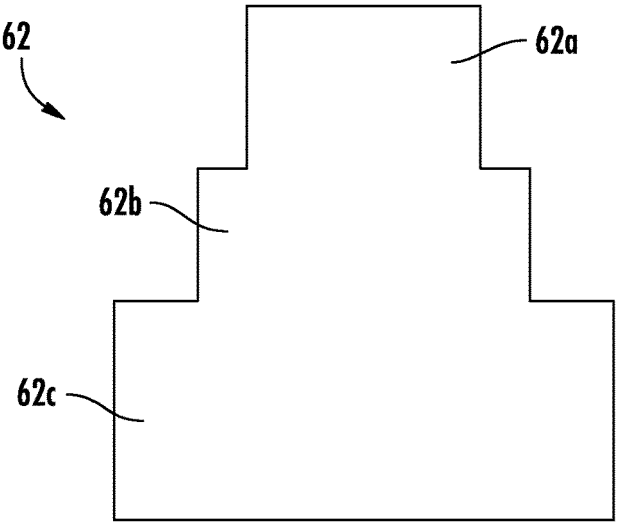
FIG. 9 is a top view of another sheet of material used to form a folded heat exchange conduit according to an embodiment.

Referring now to FIGS. 8 and 9, a cross-section of the folded heat exchange conduit 50, for example a configuration of the flow channels 60 formed therein, may vary over the length of the heat exchange conduit 50. Unless specified otherwise, the term cross-section as used herein can refer to the shape or area of an intersection of the flow channel with a plane passing there through and perpendicular to the longest axis of the flow channel 60 described. By altering the sheet of material 62, such as via the fold pattern or by removing material for example, the hydraulic diameter of the heat exchange conduit 50 may vary over the length of a flow path defined by the heat exchanger conduit 50. For example, the sheet of material 62 is cut before being folded to form multiple sections. Each section 62*a*, 62*b*, 62*c* . . . 62*n*, arranged at a different positon along a length of the sheet of material 62 may have a different width. As a result of this configuration, the internal profile of the heat exchange conduit 50 and the flow channels 60 formed therein varies along the length of the conduit 50 between sections.

Figure 8A:
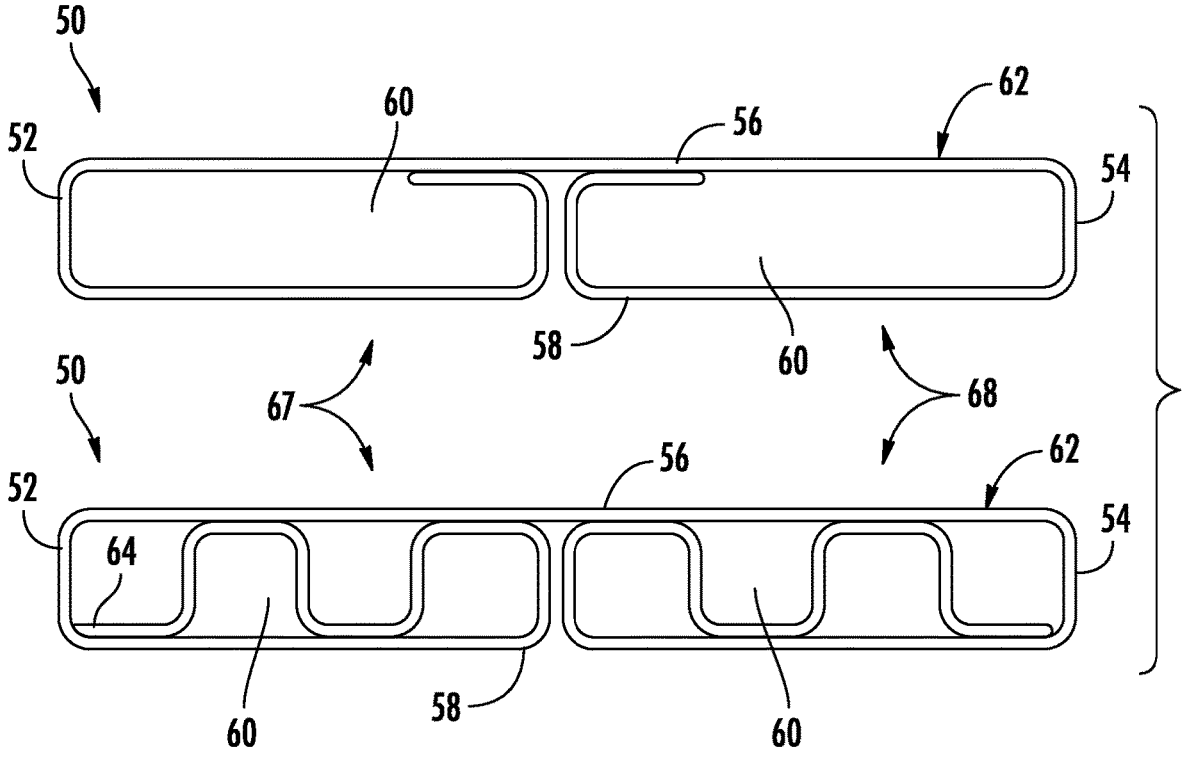
FIG. 8*a* is a cross-sectional view of the folded heat exchange conduit formed from the sheet of material of FIG. 8 at various locations along the length of the conduit according to an embodiment.
Figure 9A:
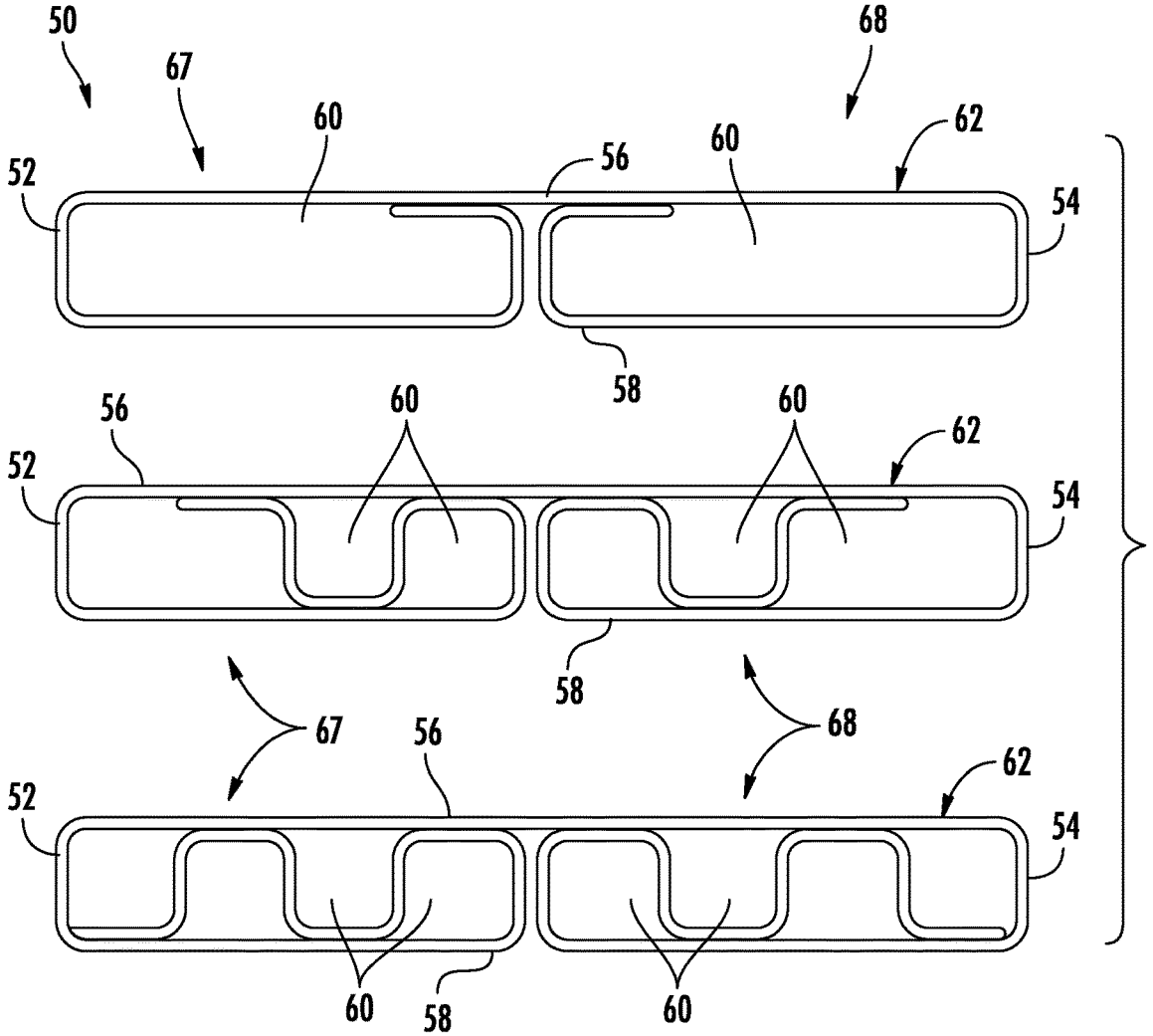
FIG. 9*a* is a cross-sectional view of the folded heat exchange conduit formed from the sheet of material of FIG. 9 at various locations along the length of the conduit according to an embodiment.

In the non-limiting embodiment illustrated in FIGS. 8 and 8*a*, the sheet of material 62 is cut to form a first section 62*a* having a first flow channel configuration and a second section 62*b* having a second flow channel configuration distinct from the first flow channel configuration. Similarly, in the example illustrated in FIGS. 9 and 9*a*, the sheet of material 62 is cut to define three sections 62*a*, 62*b*, 62*c*, each having a different flow channel configuration than the others. In the illustrated, non-limiting embodiments, the variation in flow channel configuration occurs as a result of a change in cross-sectional flow area over the length of the conduit 50. However, it should be understood that other parameters, including, but not limited to cross-sectional shape and number of leading edges disposed in the flow path of the flow channel 60 (also referred to as flow impingements) for example, may be varied to achieve a different flow channel configuration, and therefore cross-section of the conduit 50.

The hydraulic diameter of a flow channel 60 is calculated as DH=4A/P where A is the cross-sectional area of the flow channel 60 and P is the perimeter of the flow channel 60 in contact with the fluid flow. To achieve optimal performance, the ratio of the length of a flow channel 60 to the hydraulic diameter of the flow channel 60 (L/Dh) may be selected based on any pertinent parameter. For example, such parameters can include the type of fluid, the fluid phase, the fluid characteristics e.g., density, viscosity, velocity, ratios thereof, and the like) flowing through at least a portion of the heat exchanger conduit 50. In embodiments where the fluid is a liquid or two phase refrigerant, the ratio of the length to hydraulic diameter of the flow channels 60 may be between about 15 and 65. Alternatively, in embodiments where the fluid is a vaporized refrigerant, the ratio of the length to hydraulic diameter of the flow channels 60 may be between about 1.5 and 5. In embodiments where the fluid is water, the ratio of the length to hydraulic diameter of the conduits 50 is about 50 to 200 and when the fluid is a brine, the ratio of the length to hydraulic diameter of the conduits 50 is between about 150 and 600.

A heat exchanger 20 including folded heat exchange conduits 50 as described herein have improved heat transfer and pressure drop characteristics compared to conventional heat exchangers. The folded conduits 50 may additionally provide added corrosion durability and reliability while reducing the complexity and cost of the heat exchanger 20.

Embodiment 1: A heat exchange conduit, comprising: a body having a first portion including a first flow channel and a second portion including a second flow channel, wherein a cross-section of the heat exchange conduit varies over a length of the heat exchange conduit.

Embodiment 2: The heat exchange conduit according to embodiment 1, wherein a configuration of at least one of the first flow channel and the second flow channel varies over the length of the heat exchange conduit.

Embodiment 3: The heat exchange conduit according to either embodiment 1 or embodiment 2, wherein a hydraulic diameter of at least one of the first flow channel and the second flow channel varies over the length of the heat exchange conduit.

Embodiment 4: The heat exchange conduit according to embodiment 3, wherein a ratio of the length of the first flow channel or second flow channel of the heat exchange conduit to a hydraulic diameter of the first flow channel or second flow channel, respectively, is optimized based on the type and phase of a fluid configured to flow through the heat exchange conduit.

Embodiment 5: The heat exchange conduit according to embodiment 4, wherein when the fluid is at least one of a liquid and a two-phase refrigerant, a ratio of the length to the hydraulic diameter of at least one of the first flow channel and the second flow channel is about 15 to about 65.

Embodiment 6: The heat exchange conduit according to embodiment 4, wherein when the fluid is a vapor refrigerant, a ratio of the length to the hydraulic diameter of at least one of the first flow channel and the second flow channel is about 1.5 to about 5.

Embodiment 7: The heat exchange conduit according to embodiment 4, wherein when the fluid is water, a ratio of the length to the hydraulic diameter of at least one of the first flow channel and the second flow channel is about 50 to about 200.

Embodiment 8: The heat exchange conduit according to embodiment 4, wherein when the fluid is a brine, a ratio of the length to the hydraulic diameter of at least one of the first flow channel and the second flow channel is about 150 to about 600.

Embodiment 9: The heat exchange conduit according to any of the preceding claims, wherein the body includes a generally planar sheet of material folded to form the first portion and the second portion.

Embodiment 10: The heat exchange conduit according to any of the preceding embodiments, wherein an interior surface of the heat exchange conduit includes a texture or pattern to form a boundary layer disruption of a fluid passing through the tube.

Embodiment 11: The heat exchange conduit according to any of the preceding embodiments, wherein an exterior surface of the heat exchange conduit includes a texture or pattern to form a boundary layer disruption of a fluid passing around the tube.

Embodiment 12: A heat exchanger, comprising: a first header; a second header; a plurality of heat exchange conduits arranged in spaced parallel relationship and fluidly coupling the first header and second header, wherein a configuration of at least one of the plurality of heat exchange conduits has varies along a length of the heat exchange conduit.

Embodiment 13: The heat exchanger according to embodiment 12, wherein the at least one of the plurality of heat exchange conduits includes a first folded portion having one or more first flow channels and a second folded portion having one or more second flow channels, wherein at least one of a cross-sectional area and a cross-sectional shape of the one or more first flow channels or the one or more second flow channels varies over the length of the heat exchange conduit.

Embodiment 14: The heat exchanger according to embodiment 13, wherein the first folded portion is part of a first tube bank and the second folded portion is part of a second tube bank.

Embodiment 15: The heat exchanger according to any of the preceding embodiments, wherein a hydraulic diameter of the at least one first flow channel and second flow channel varies over the length of the heat exchange conduit.

Embodiment 16: A method of forming a heat exchange conduit, comprising: providing a generally planar piece of material; folding a first end of the piece of material to form a first portion of the heat exchange conduit, the first portion including at least one first flow channel; and folding a second, opposite end of the piece of material to form a second portion of the heat exchange conduit, the second portion including at least one second flow channel, wherein a cross-section of the heat exchange conduit is non-uniform over a the length of the tube.

Embodiment 17: The method according to claim 16, wherein a single surface of the piece of material forms a leading edge, trailing edge, first surface and second surface of the heat exchange conduit.

Embodiment 18: The method according to either claim 16 or claim 17 wherein forming the first portion includes forming a plurality of first flow channels.

Embodiment 19: The method according to any of the preceding claims, further comprising removing part of the piece of material such that a first section of the piece of material has a first width and a second section of the piece of material has a second width, the first width being different than the second width.

Embodiment 20: The method according to any of the preceding claims, further comprising altering the piece of material to include a texture or pattern before folding the material, wherein when the piece of material is folded to form the heat exchange conduit, the texture or pattern is arranged at an interior surface of the heat exchange conduit.

While the present disclosure has been particularly shown and described with reference to the exemplary embodiments as illustrated in the drawing, it will be recognized by those skilled in the art that various modifications may be made without departing from the scope of the present disclosure. Therefore, it is intended that the present disclosure not be limited to the particular embodiment(s) disclosed as, but that the disclosure will include all embodiments falling within the scope of the appended claims.

What is claimed is:

1. A heat exchange conduit, comprising:

a body having a leading edge, a trailing edge, a first surface, and a second surface, the body including a first portion having an interior extending between the leading edge, the first surface, a first portion of the second surface, and a first internal side, and a second portion having an interior extending between the trailing edge, the first surface, a second portion the second surface, and a second internal side;

wherein the interior of the first portion includes at least one first flow channel and the interior of the second portion includes a second flow channel;

wherein the body includes a generally planar sheet of material folded such that a single surface of the sheet of material forms the leading edge, the first surface, the first portion of the second surface, and the first internal side of the first portion and each of the trailing edge, the first surface, the second portion of the second surface, and the second internal side of the second portion;

wherein a width of the generally planar sheet of material varies over a length of the heat exchange conduit such that a number of first flow channels formed in the first portion varies over a length of the heat exchange conduit.

2. The heat exchange conduit according to claim 1, wherein a configuration of the at least one first flow channel and the second flow channel varies over the length of the heat exchange conduit.

3. The heat exchange conduit according to claim 1, wherein a hydraulic diameter of at least one of the at least one first flow channel and the second flow channel varies over the length of the heat exchange conduit.

4. The heat exchange conduit according to claim 3, wherein a ratio of a length of the at least one first flow channel or second flow channel of the heat exchange conduit to a hydraulic diameter of the at least one first flow channel or second flow channel, respectively, is optimized based on the type and phase of a fluid configured to flow through the heat exchange conduit.

5. The heat exchange conduit according to claim 4, wherein when the fluid is at least one of a liquid and a two-phase refrigerant, a ratio of the length to the hydraulic diameter of at least one of the at least one first flow channel and the second flow channel is about 15 to about 65.

6. The heat exchange conduit according to claim 4, wherein when the fluid is a vapor refrigerant, a ratio of the length to the hydraulic diameter of at least one of the first flow channel and the second flow channel is about 1.5 to about 5.

7. The heat exchange conduit according to claim 4, wherein when the fluid is water, a ratio of the length to the hydraulic diameter of at least one of the first flow channel and the second flow channel is about 50 to about 200.

8. The heat exchange conduit according to claim 4, wherein when the fluid is a brine, a ratio of the length to the hydraulic diameter of at least one of the first flow channel and the second flow channel is about 150 to about 600.

9. The heat exchange conduit according to claim 1, wherein an interior surface of the heat exchange conduit includes a texture or pattern to form a boundary layer disruption of a fluid passing through the heat exchange conduit.

10. The heat exchange conduit according to claim 1, wherein an exterior surface of the heat exchange conduit includes a texture or pattern to form a boundary layer disruption of a fluid passing around the heat exchange conduit.

11. A heat exchanger, comprising:

a first header;

a second header;

a plurality of heat exchange conduits arranged in spaced parallel relationship and fluidly coupling the first header and second header, at least one of the plurality of heat exchange conduits including a body having a leading edge, a trailing edge, a first surface, and a second surface, the body including a first portion having an interior extending between the leading edge, the first surface, a first portion of the second surface, and a first internal side and a second portion having an interior extending between the trailing edge, the first surface, a second portion of the second surface, and a second internal side, the interior of the first portion including at a first flow channel and the interior of the second portion including a second flow channel;

wherein the body of the at least one heat exchanger conduit includes a generally planar sheet of material folded such that a single surface of the sheet of material forms the leading edge, the first surface, the first portion of the second surface and the first internal side of the first portion and the trailing edge, the first surface, the second portion of the second surface, and the second internal side of the second portion;

wherein a width of the generally planar sheet of material varies over a length of the heat exchange conduit such that a number of flow channels formed in at least one of the first portion and the second portion varies along a length of the heat exchange conduit.

12. The heat exchanger according to claim 11, wherein the first portion has one or more first flow channels and the second portion has one or more second flow channels, wherein at least one of a cross-sectional area and a cross-sectional shape of the one or more first flow channels or the one or more second flow channels varies over the length of the heat exchange conduit.

13. The heat exchanger according to claim 12, wherein the first portion is part of a first tube bank and the second portion is part of a second tube bank.

14. The heat exchanger according to claim 11, wherein a hydraulic diameter of the at least one first flow channel and second flow channel varies over the length of the heat exchange conduit.

* * * * *